US010794616B2

(12) United States Patent
Longsworth

(10) Patent No.: US 10,794,616 B2
(45) Date of Patent: Oct. 6, 2020

(54) HYBRID BRAYTON—GIFFORD-MCMAHON EXPANDER

(71) Applicant: Sumitomo (SHI) Cryogenics of America, Inc., Allentown, PA (US)

(72) Inventor: Ralph Longsworth, Allentown, PA (US)

(73) Assignee: SUMITOMO (SHI) CRYOGENIC OF AMERICA, INC., Allentown, PA (US)

( * ) Notice: Subject to any disclaimer, the term of this patent is extended or adjusted under 35 U.S.C. 154(b) by 286 days.

(21) Appl. No.: 14/577,361

(22) Filed: Dec. 19, 2014

(65) Prior Publication Data

US 2015/0176867 A1 Jun. 25, 2015

Related U.S. Application Data

(60) Provisional application No. 61/917,999, filed on Dec. 19, 2013.

(51) Int. Cl.
*F25B 9/14* (2006.01)
*F25B 9/10* (2006.01)

(52) U.S. Cl.
CPC . *F25B 9/14* (2013.01); *F25B 9/10* (2013.01)

(58) Field of Classification Search
CPC ..... F25D 9/10; F25D 9/14; F25B 9/10; F25B 9/14
USPC ..... 62/6
See application file for complete search history.

(56) References Cited

U.S. PATENT DOCUMENTS

| | | | | |
|---|---|---|---|---|
| 3,045,436 | A | 7/1962 | Gifford et al. | |
| 3,613,385 | A * | 10/1971 | Hogan et al. | F25B 9/14 62/6 |
| 3,902,328 | A * | 9/1975 | Claudet | F02G 1/0445 62/6 |
| 4,708,725 | A | 11/1987 | Okumura | |
| 5,361,588 | A * | 11/1994 | Asami | F25B 9/14 60/520 |
| 6,216,467 | B1 | 4/2001 | O'Neil et al. | |
| 7,674,099 | B2 | 3/2010 | Dunn | |
| 8,776,534 | B2 | 7/2014 | Dunn et al. | |
| 2011/0219810 | A1 | 9/2011 | Longsworth | |
| 2012/0085121 | A1 | 4/2012 | Longsworth | |
| 2012/0285181 | A1 * | 11/2012 | Dunn | F25B 9/06 62/6 |

FOREIGN PATENT DOCUMENTS

| | | | |
|---|---|---|---|
| JP | 50-7304 | B | 3/1975 |
| JP | 05-322343 | A | 12/1993 |
| WO | 2012/154299 | A1 | 11/2012 |

OTHER PUBLICATIONS

Japanese Office Action dated Apr. 18, 2017 for the Corresponding Japanese Patent Application No. 2016-534963.
Korean Office Action dated Mar. 27, 2017 for the Corresponding Korean Patent Application No. 10-2016-7015731.

(Continued)

*Primary Examiner* — Brian M King
(74) *Attorney, Agent, or Firm* — Katten Muchin Rosenman LLP

(57) ABSTRACT

A hybrid expander combines a Brayton engine first stage with one or more GM colder stages that uses the flow from the Brayton engine to provide refrigeration at one or more remote heat stations.

11 Claims, 4 Drawing Sheets

(56) References Cited

OTHER PUBLICATIONS

International Preliminary Report on Patentability dated Jun. 21, 2016 from the corresponding International Application No. PCT/US2014/071506.
International Search Report and the Written Opinion of the International Searching Authority dated Apr. 8, 2015 from the corresponding International Application No. PCT/US2014/071506.
Korean Office Action dated Mar. 27, 2018 for the Corresponding Korean Patent Application No. 10-2016-7015731.
Chinese Office Action dated Mar. 5, 2018 for the Corresponding Chinese Patent Application No. 201480069314.5.
Korean Office Action dated Dec. 14, 2017 for the Corresponding Korean Patent Application No. 10-2016-7015731.
Japanese Office Action dated Jan. 30, 2018 for the Corresponding Japanese Patent Application No. 2016-534963.
Korean Office Action dated Jun. 21, 2018 for the Corresponding Korean Patent Application No. 10-2018-7012182.
Chinese Office Action dated Sep. 30, 2018 for the Corresponding Chinese Patent Application No. 201480069314.5.
Korean Office Action dated Oct. 29, 2018 for the Corresponding Korean Patent Application No. 10-2018-7012182.
Chinese Office Action dated Mar. 28, 2019 for the Corresponding Chinese Patent Application No. 201480069314.5.
Selected Experiments on Higher Physics (Wu, Bai-mei, et. al., Publishing House of Science and Technology University of China, Aug. 2005, 1st edition, pp. 7-10) has recited the cold end has a GM expander of gas inlet and outlet pipes.
Low-Noise Systems in the Deep Space Network (MacGregor S. Reid, Tsinghua University Press, May 2003, 1st edition, pp. 143-145) has recited that the cold end is not provided with a GM expander of inlet and outlet valves and pipes.
Korean Office Action dated Jan. 2, 2019 for the Corresponding Korean Patent Application No. 10-2018-7012182.
Korean Office Action dated May 30, 2019 for the Corresponding Korean Patent Application No. 10-2019-7006390.
British Examination Report dated Oct. 2, 2019 for the Corresponding British Patent Application No. GB1608098.8.

* cited by examiner

HYBRID BRAYTON—GIFFORD-MCMAHON EXPANDER

CROSS-REFERENCE TO RELATED APPLICATIONS

This application is a non-provisional counterpart to and claims priority from U.S. Ser. No. 61/917,999, filed Dec. 19, 2013, which is pending and is hereby incorporated in its entirety for all purposes.

BACKGROUND OF THE INVENTION

1. Field of the Invention

The invention relates to a refrigerator for producing refrigeration at two or more cryogenic temperatures by combining a first stage Brayton cycle engine with one or more Gifford-McMahon ("GM") expanders. Specifically, the invention relates to a refrigerator wherein the cold gas that circulates through the Brayton cycle engine is further cooled by one or more GM expanders and transport refrigeration to one or more remote heat exchangers. Therein, the can be used for example to cool a superconducting magnet at 30 K and a surrounding shield at 70 K.

2. Background Information

A refrigeration system that operates on the Brayton cycle consists of a compressor that supplies gas at a discharge pressure to a counterflow heat exchanger, which admits gas to an expansion space through a cold inlet valve, expands the gas adiabatically, exhausts the expanded gas (which is colder) through in outlet valve, circulates the cold gas through a load being cooled, then returns the gas through the counterflow heat exchanger to the compressor at a return pressure.

U.S. Pat. No. 3,045,436, by W. E. Gifford and H. O. McMahon describes the Gifford-McMahon ("GM") cycle. This refrigerator system also consists of a compressor that supplies gas at a discharge pressure to an expander which admits gas through an inlet valve to the warm end of a regenerator heat exchanges and then into an expansion space at the cold end of a piston from whence it returns back through the regenerator and a warm outlet valve to the compressor at a return pressure. The typical GM type expander being built today has the regenerator located inside the piston so the piston/regenerator becomes a displacer that moves from the cold end to the warm end with the gas at high pressure then from the warm end to the cold end with the gas at low pressure. An important difference between GM and Brayton type refrigerators is that Brayton cycle refrigerators can distribute cold gas to a remote load while the cold expanded gas in GM expanders is contained within the expansion space.

U.S. Patent Application Publication 2011/0219810 dated Sep. 15, 2011 by R. C. Longsworth describes a reciprocating expansion engine operating on a Brayton cycle in which the piston has a drive stem at the warm end that is driven by a mechanical drive, or gas pressure that alternates between high and low pressures, and the pressure at the warm end of the piston in the area around the drive stem is essentially the same as the pressure at the cold end of the piston while the piston is moving. U.S. patent application Ser. No. 13/106,218 dated May 12, 2011 by S. Dunn, et al., describes alternate means of actuating the expander piston. A compressor system that can be used to supply gas to these engines is described in published patent application U.S. 2007/0253854 titled "Compressor With Oil Bypass" by S. Dunn filed on Apr. 28, 2006. The engines described in these applications provide examples of Brayton engines that can be used in this present invention.

Adding a second piston to a Brayton engine requires a second pair of valves and their associated actuators whereas adding a GM displacer attached to the Brayton piston utilizes the first stage valves to cycle pressure to the second stage. It is thus an object of the present invention to combine the advantage of the Brayton engine to output cold gas that can be circulated to a remote heat station with the simplicity of construction of adding one or more additional stages of GM cooling to the Brayton engine and use the circulating gas to cool one or more remote heat stations at colder temperatures.

SUMMARY OF THE INVENTION

The present invention combines a Brayton engine first stage with one or more GM colder stages that uses the flow from the Brayton engine to provide refrigeration at one or more remote heat stations.

A hybrid expander for producing refrigeration at cryogenic temperatures operates with gas supplied from a source at a first pressure and returned to the source at a second pressure. The second pressure is lower than the first pressure. The hybrid expander includes

- a Brayton expansion engine producing refrigeration at a first temperature, the Brayton expansion engine comprising a reciprocating piston having a piston warm end and a piston cold end, and
- a Gifford-McMahon expander producing refrigeration at a second temperature, the second temperature being colder than the first temperature, the Gifford-McMahon expander comprising a displacer, the displacer being attached to the piston cold end and reciprocating contemporaneously with the piston.

DETAILED DESCRIPTION OF THE INVENTION

In accordance with one or more embodiments of the present invention, FIGS. 1 to 4 use the same number and the same diagrammatic representation to identify equivalent parts.

Since expansion engines are usually oriented with the cold end down, in order to minimize convective losses in the heat exchanger, the movement of the piston from the cold end toward the warm end is frequently referred to as moving up, thus the piston moves up and down or to the top and bottom. The figures do not show the warm mounting plate on which warm flange 7 is mounted and the vacuum housing below the warm flange that separates the cold components from the air outside.

Figure 1:
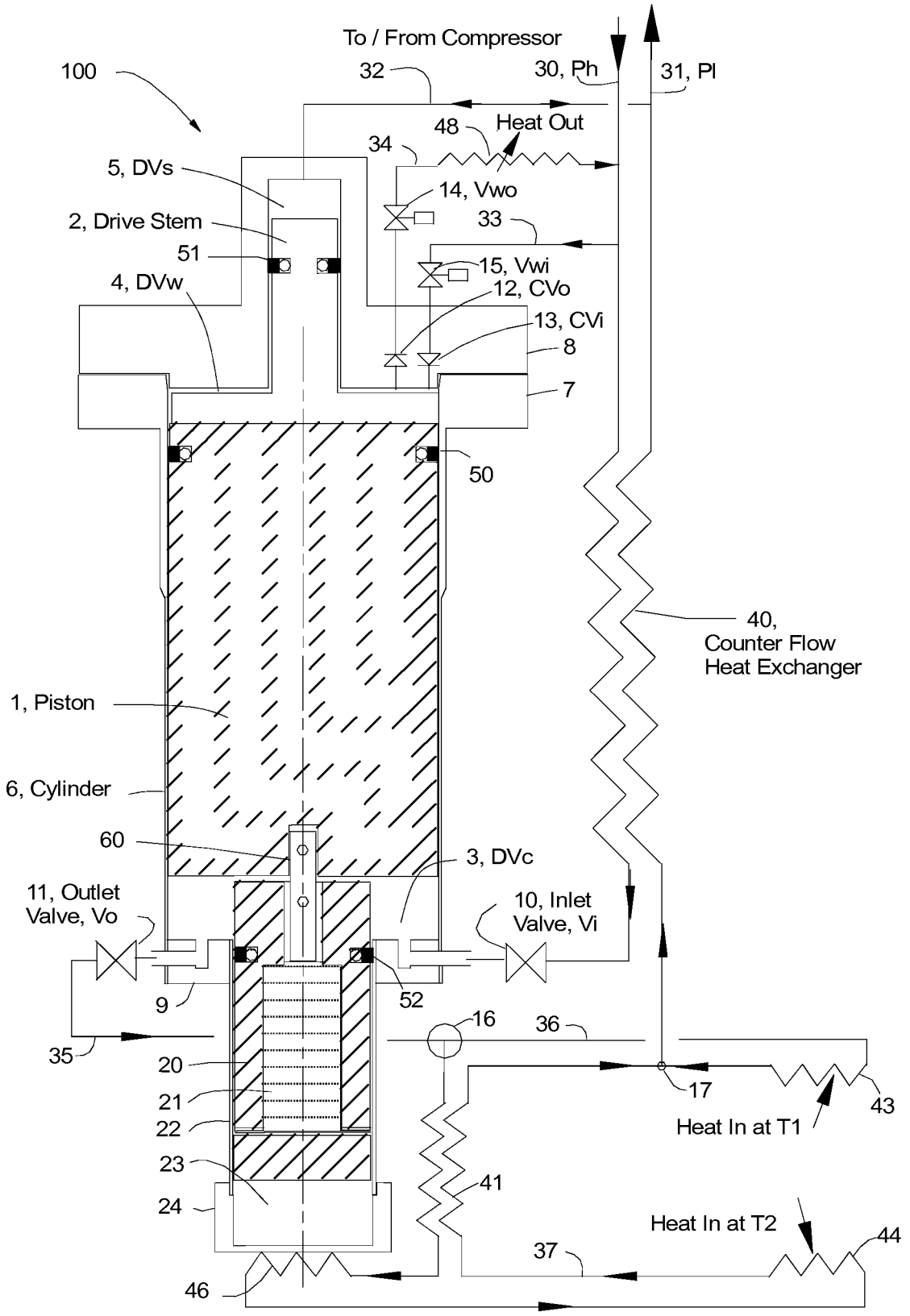
FIG. 1 is a schematic view of a hybrid expander 100 comprising a pneumatically actuated gas balanced Brayton engine first stage, a GM second stage, a remote first stage heat exchanger, and a remote second stage heat exchanger.
Figure 2:
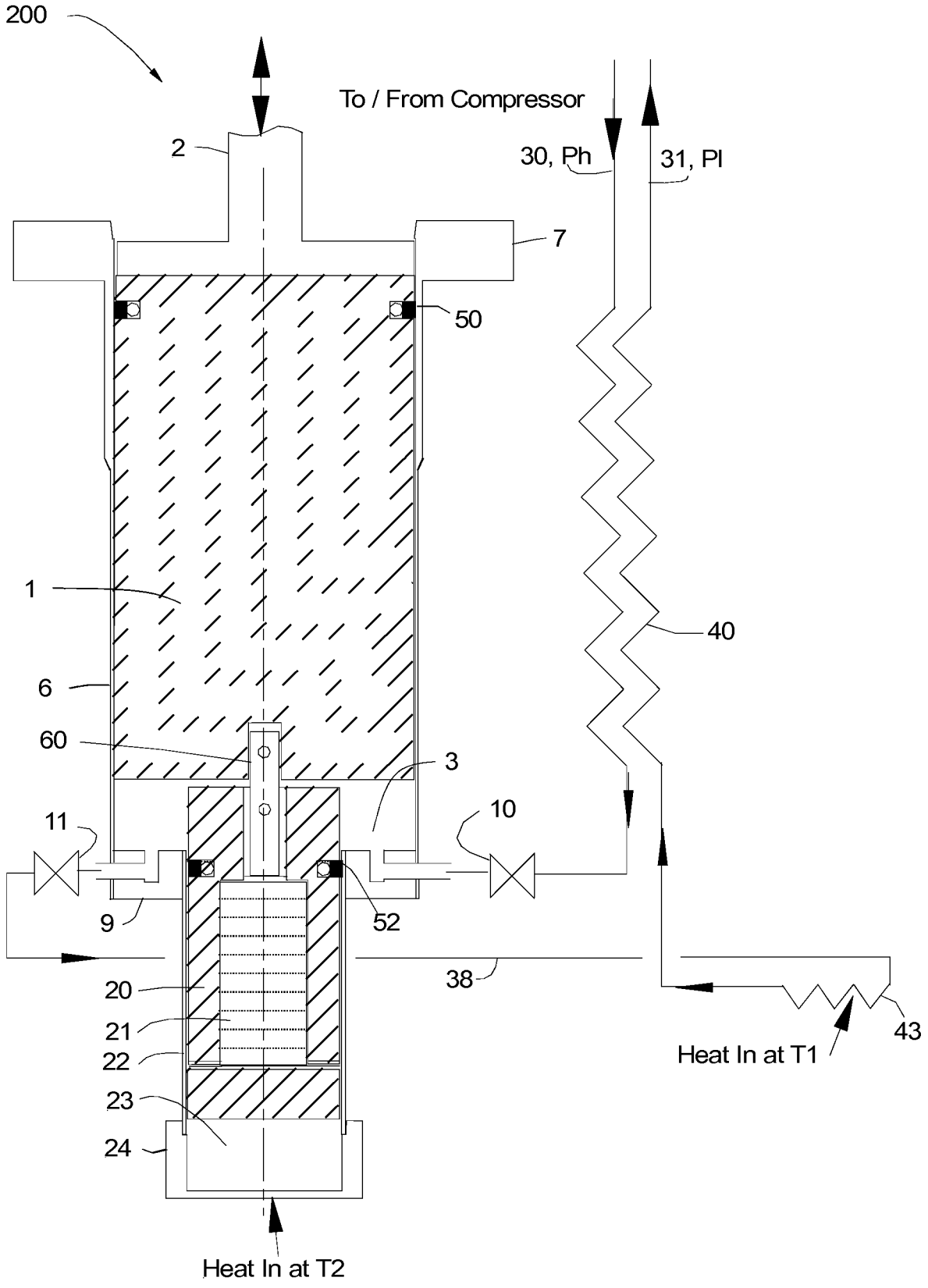
FIG. 2 is a schematic view of a hybrid expander 200 comprising a Brayton engine first stage, a GM second stage, a remote first stage heat exchanger, and an integral second stage heat exchanger.
Figure 3:
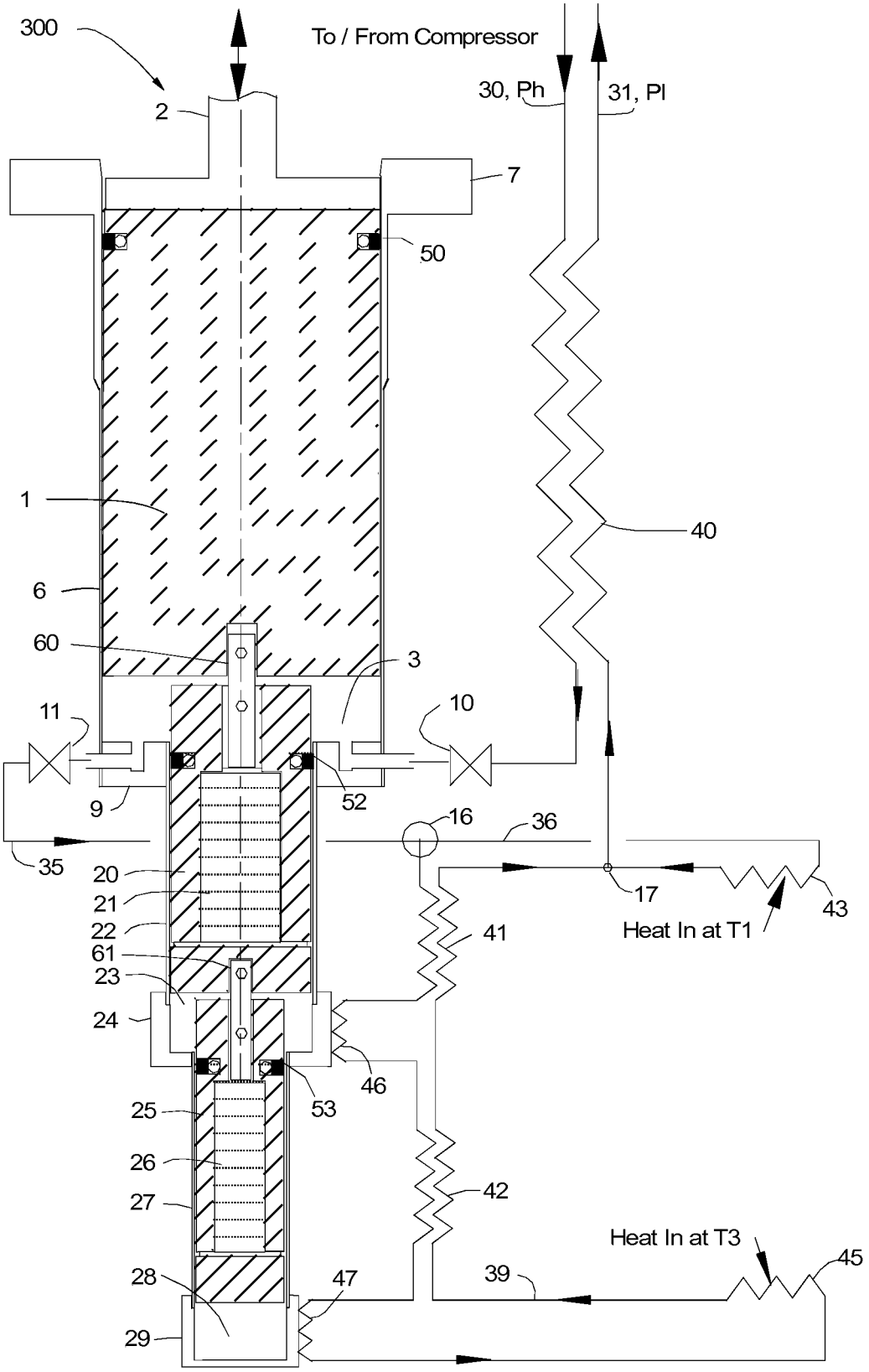
FIG. 3 is a schematic view of a hybrid expander 300 comprising a Brayton engine first stage, a GM second stage, a GM third stage, a remote first stage heat exchanger, and a remote third stage heat exchanger.
Figure 4:
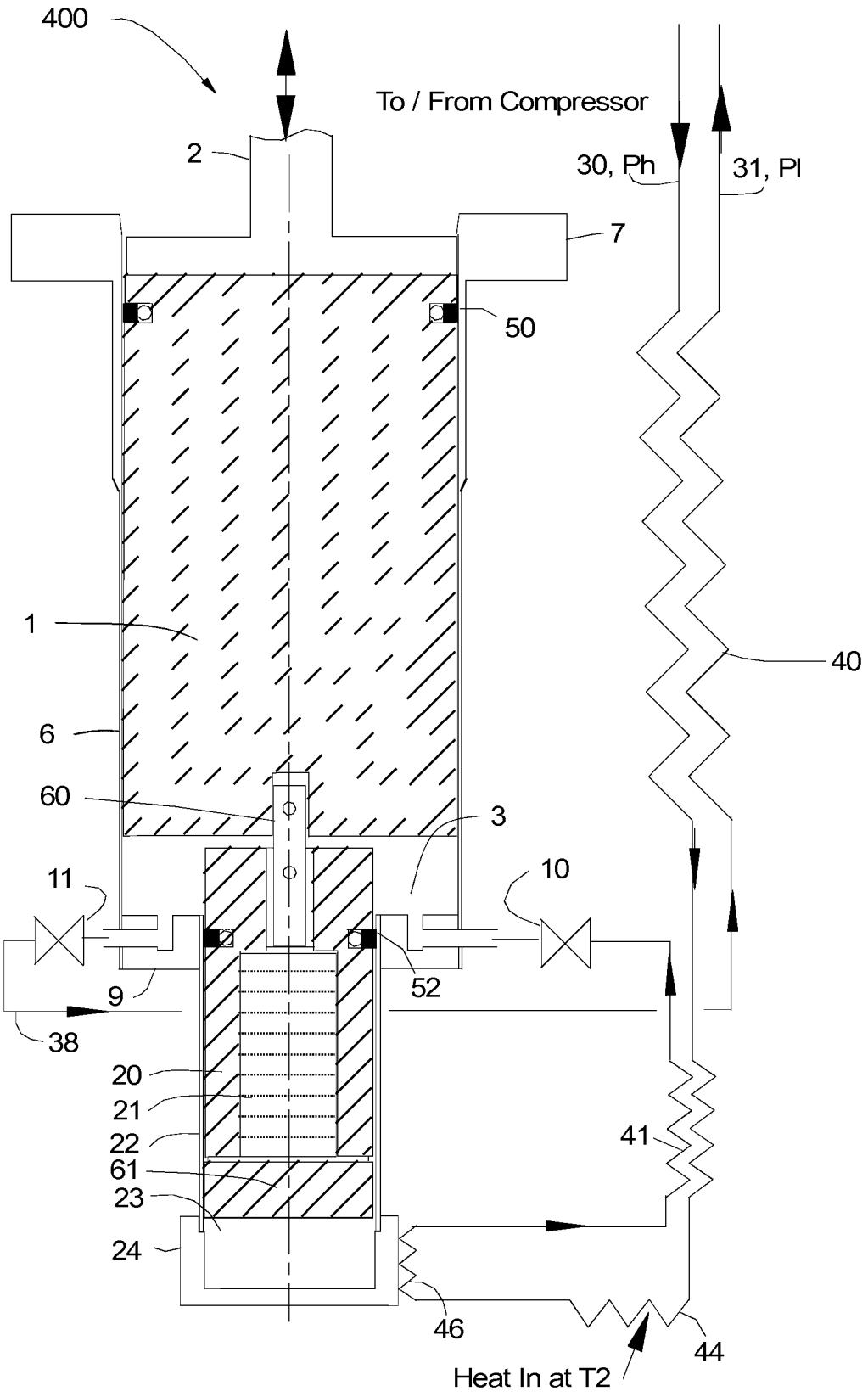
FIG. 4 is a schematic view of a hybrid expander 400 comprising a Brayton engine first stage, a GM second stage, and a remote second stage heat exchanger.

FIG. 1 illustrates the Brayton engine drive mechanism described in U.S. Patent Application Publication 2012/0285181 published Nov. 14, 2012 and titled "Gas Balanced Cryogenic Expansion Engine," while FIGS. 2, 3, and 4 illustrate generic drive mechanisms to which the present invention is modified.

In FIG. 1, a hybrid expander 100 comprises a Brayton piston/GM displacer assembly, a drive assembly at the warm end, a cylinder assembly, and a piping assembly that includes multiple heat exchangers. Brayton piston 1 is attached to drive stem 2 at the warm end and connected by coupling 60 at the cold end to GM displacer 20 which contains regenerator 21. Seal 51 prevents gas from by-passing from displaced volume DVs 5, which is disposed above drive stem 2, to displaced volume DVw 4, which is disposed above Brayton piston 1. Seal 50 prevents gas from by-passing from DVw 4 to displaced volume DVc 3, which is below Brayton piston 1. Seal 52 prevents gas from by-passing from displaced volume DVc 3 to displaced volume 23 below displacer 20. This piston/displacer assembly reciprocates in a cylinder assembly. The cylinder assembly includes warm flange 7, first stage cylinder 6, first stage end cap 9, second stage cylinder 22, and second stage end cap 24.

The pneumatic drive assembly includes components that are not shown which open inlet valve Vi 10, when piston 1 is near the cold end and closes it when piston 1 is near the top, and which open outlet valve Vo, 11, when piston 1 is at the top and closes it when piston 1 is near the bottom. Gas pressure in displaced volumes 3 and 23, as well as regenerator 21, is nearly the same, differing only due to pressure drop through regenerator 21 when gas is moving.

When piston 1 reaches the top, displaced volumes DVc 3 and DVw 4 have gas at a pressure near high pressure Ph in them. With inlet valve Vi 10 closed, outlet valve Vo 11 opens and allows cold gas to flow out to low pressure Pl. The pressure difference between displaced volumes DVw 4 and DVc 3 causes piston 1 to move down and draw gas into displaced volume DVw 4 from high pressure supply line 30 through a warm inlet valve Vwi 15, inlet check valve CVi 13, and connecting lines 33. The speed at which piston 1 moves down is controlled by the setting of warm inlet valve Vwi 15.

When piston 1 reaches the bottom, outlet valve Vo 11 is closed and time is allowed for gas to continue to flow into DVw 4 until the pressure is near pressure Ph. Inlet valve Vi 10 is then opened to admit gas at pressure Ph. The force imbalance due to pressure Ph acting at the cold end of piston 1 and pressure Pl acting on drive stem 2 compresses gas in displaced volume DVw 4 above pressure Ph, i.e., a third pressure, and pushes it is out through outlet check valve CVo 12, warm outlet valve Vwo, 14, aftercooler 48, and connecting lines 34 to high pressure line 30.

The speed at which piston 1 moves up is controlled by the setting of warm outlet valve Vwo 14. Displaced volume DVs 5 is connected through line 32 to low pressure return line 31; thus, it is always at pressure Pl.

The piping assembly comprises

- a counterflow heat exchanger 40 between room temperature and a first stage temperature,
- a counterflow heat exchanger 41 between a first stage temperature and a second stage temperature,
- a remote heat exchanger 43 which receives heat from a load at temperature T1,
- a remote heat exchanger 44 which receives heat from a load at temperature T2,
- a heat exchanger 46 which transfers heat from the circulating gas to the gas in GM expansion space 23 through second stage cold end 24, and connecting piping.

The piping is identified as connecting the previously listed components in the system. Therein,

- line 30 carries gas at pressure Ph from the compressor to inlet valve Vi 10 through heat exchanger 40,
- line 35 carries gas at pressure Pl from outlet valve Vo 11 to flow splitter 16,
- line 36 which carries a first fraction of the gas from splitter 16 through heat exchanger 43 to tee 17,
- line 37 carries the balance of the gas through heat exchangers 41, 46, 44, and 41 to tee 17, and
- line 31 returns gas to the compressor from tee 17 through heat exchanger 40.

FIG. 2 shows hybrid expander 200 comprising a Brayton piston/GM displacer assembly, a cylinder assembly, and a piping assembly that includes multiple heat exchangers. The means for driving the piston/displacer assembly up and down is not shown but can be either a mechanical or pneumatic mechanism. The Brayton piston/GM displacer assembly and the cylinder assembly are the same as expander 100. Expander 200 differs from expander 100 in that the piping assembly has only one remote heat station. Cold gas flows from outlet valve Vo 11 through remote heat exchanger 43 to heat exchanger 40 through line 38. Heat flows into heat exchanger 43 from a load at temperature T1 and flows directly into cold end 24 from a colder load at temperature T2.

FIG. 3 shows hybrid expander 300 comprising a Brayton piston/GM displacer assembly, a cylinder assembly, and a piping assembly that includes multiple heat exchangers. The means for driving the piston/displacer assembly up and down is not shown but can be either a mechanical or pneumatic mechanism. The first two stages of the Brayton piston/GM displacer assembly are the same as shown in FIGS. 1 and 2. This embodiment of the invention includes a third stage GM displacer 25 containing regenerator 26 and seal 53 and which is coupled to second stage displacer 20 by coupling 61 and reciprocates within the extension of the cylinder assembly consisting of cylinder 27 and cold end 29. Refrigeration is produced by gas expanding in displaced volume 28.

The piping in expander 300 differs from expander 100 in that the piping to the colder remote heat exchanger is different. The first fraction of cold gas that flows through line 36 from splitter 16 through remote heat exchanger 43 to tee 17 is the same. The balance of the flow is cooled to lower temperatures as it flows in line 39 from splitter 16 through heat exchangers 41, 46, 42, and 47, and then is warmed as it flows through heat exchangers 45, 42, and 41 before joining the first fraction of flow at tee 17. Heat is transferred from a load at temperature T1 to heat exchanger 43 and from a load at temperature T3 to heat exchanger 45.

FIG. 4 shows hybrid expander 400 comprising the same Brayton piston/GM displacer assembly and cylinder assembly as expander 100. The means for driving the piston/displacer assembly up and down is not shown but can be either a mechanical or pneumatic mechanism. The piping assembly shows the options of circulating gas at pressure Ph through a single remote heat exchanger which is at temperature T2. Gas at pressure Ph has a greater density than gas at pressure Pl thus the piping can be smaller. FIG. 4 shows the option of using all of the first stage refrigeration to remove thermal losses in heat exchanger 40 and having all of the flow that is circulated by the engine go through heat exchanger 44 at temperature T2. The piping in expander 400 includes line 30 which extends from the compressor through heat exchangers 40, 41, 44, 46, and 41 to inlet valve Vi 10. Gas at pressure Pl flows through line 38 from outlet valve Vo 11 to heat exchanger 40.

These embodiments provide examples of many ways that the basic concepts can be applied. in accordance with one or more embodiments of the present invention, a GM displacer to the cold end of a Brayton engine piston, thus using the inlet and outlet valves of the Brayton engine to cycle gas to the volumes displaced by the piston and displacer. In accordance with one or more embodiments of the present invention, a gas is circulated by the Brayton engine to remove heat from one or more remote locations, the gas being at either high or low pressure. Counter-flow heat exchangers can be used between the GM expander stages to make the gas available to transfer heat from remote loads to the cold stage(s) of the GM expander(s) with small thermal losses imposed on the GM stage(s) by the counter-flow heat exchanger(s). Heat can alternately be transferred directly to a GM heat station. The drive mechanism for the Brayton engine and the means for opening and closing the inlet and outlet valves is a matter of choice. Helium is the preferred gas for most cryogenic refrigerators but other gases such as hydrogen and neon might be used.

Calculations have been made for the cooling that would be expected for hybrid expanders 100 and 400 from a compressor that compresses 11 g/s of helium at room temperature from 0.8 MPa to 2.2 MPa and draws about 14 KW of power. A hybrid expander 100 having a Brayton engine piston with a diameter of 100 mm and a GM displacer with a diameter of 50 mm would provide about 200 W of cooling at a remote heat exchanger at 80 K and 100 W of cooling at a remote heat exchanger at 30 K. A hybrid expander 400 having a Brayton engine piston with a diameter of 100 mm and a GM displacer with a diameter of 75 mm would provide about 175 W of cooling at a remote heat exchanger at 30 K and no cooling at 100 K. In this design the cooling from the Brayton engine is only used to remove the thermal losses in heat exchanger 40.

What is claimed is:

1. A hybrid expander for producing refrigeration at cryogenic temperatures, the hybrid expander operating with gas supplied from a compressor at a first pressure and returned to the compressor at a second pressure, the second pressure being lower than the first pressure, the hybrid expander comprising:

a high pressure line connected to the compressor to supply the gas from the compressor at the first pressure;

a low pressure line connected to the compressor to return the gas to the compressor at the second pressure;

a Brayton expansion engine (BR) producing refrigeration at a first temperature, the Brayton expansion engine comprising:

a BR cylinder;

a BR piston reciprocating in the BR cylinder creating a BR cylinder cold displaced volume at a BR piston cold end;

a BR cold inlet valve connected to the high pressure line to draw gas from the high pressure line into the BR cylinder cold displaced volume;

a BR cold outlet valve connected to the low pressure line to return gas in the BR cylinder cold displaced volume to the low pressure line; and a counterflow heat exchanger connected to the compressor through the high and low pressure lines at a BR warm end; and a Gifford-McMahon expander (GM) producing refrigeration at a second temperature, the second temperature being colder than the first temperature, the Gifford-McMahon expander comprising:

a GM cylinder connected to the BR cylinder, wherein a diameter of the BR cylinder is greater than a diameter of the GM cylinder; and a displacer having a displacer warm end in the BR cylinder cold displaced volume and a displacer cold end, the displacer attached to the BR piston cold end and reciprocating in the GM cylinder creating a GM cylinder cold displaced volume at the displacer cold end, wherein gas flows between the BR cylinder cold displaced volume and the GM cylinder cold displaced volume through a regenerator, and the gas flows through the regenerator from the BR cylinder cold displaced volume to the GM cylinder cold displaced volume while the GM cylinder cold displaced volume is increasing, and from the GM cylinder cold displaced volume to the BR cylinder cold displaced volume while the GM cylinder cold displaced volume is decreasing, and wherein the BR cold inlet valve draws the gas from the high pressure line into the GM cylinder cold displaced volume through the regenerator, and the BR cold outlet valve returns gas in the GM cylinder cold displaced volume to the low pressure line through the regenerator.

2. The hybrid expander of claim 1, further comprising a first cold heat station cooled by gas before or after flowing through the Brayton expansion engine at a temperature near the first temperature.

3. The hybrid expander of claim 2, further comprising a second cold heat station that is cooled by gas at a temperature near the second temperature.

4. The hybrid expander of claim 1, further comprising a drive stem attached to a BR piston warm end of the BR piston.

5. The hybrid expander of claim 1, wherein the BR cold inlet valve is controllable and the BR cold outlet valve is controllable.

6. The hybrid expander of claim 1, further comprising a drive stem comprising a stem top end and a stem bottom end, the stem bottom end attached to a BR piston warm end;

a BR warm inlet valve connected to the high pressure line to draw the gas from the high pressure line into a BR cylinder warm displaced volume;

a BR warm outlet valve connected to the high pressure line to return gas in the BR cylinder warm displaced volume to the high pressure line;

a check inlet valve connecting the BR warm inlet valve to the BR cylinder warm displaced volume; and a check outlet valve connecting the BR cylinder warm displaced volume to the BR warm outlet valve, wherein each of the check inlet and outlet valves is connected to the BR cylinder warm displaced volume directly adjacent the stem top end.

7. The hybrid expander of claim 6, wherein the check inlet valve is controllable and the check outlet valve is controllable.

8. The hybrid expander of claim 1, further comprising a second Gifford-McMahon expander producing refrigeration at a third temperature, the third temperature being colder than the second temperature, the second Gifford-McMahon expander comprising a second displacer, the second displacer being attached to the displacer cold end of the Gifford McMahon expander and reciprocating contemporaneously with the BR piston.

9. The hybrid expander of claim 1, further comprising a line containing gas that flows through the BR cylinder cold displaced volume and being drawn to the Gifford-McMahon expander, the line comprising a heat exchanger for transferring heat from gas in the line to gas in the GM cylinder cold displaced volume.

10. The hybrid expander of claim 1, wherein the GM cylinder cold displaced volume has no inlet and outlet valves.

11. The hybrid expander of claim 1, wherein the BR cold inlet valve is open while the GM cylinder cold displaced volume is increasing, and is closed while the GM cylinder cold displaced volume is decreasing.

* * * * *